US006533197B1

(12) United States Patent
Takeuchi et al.

(10) Patent No.: US 6,533,197 B1
(45) Date of Patent: Mar. 18, 2003

(54) DEVICE FOR DISCHARGING RAW MATERIAL-FUEL

(75) Inventors: Yukihisa Takeuchi, Nishikamo-gun (JP); Hiroyuki Tsuji, Nagoya (JP); Nobuo Takahashi, Owariasahi (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/720,351

(22) PCT Filed: Jun. 30, 1999

(86) PCT No.: PCT/JP99/03510

§ 371 (c)(1),
(2), (4) Date: Dec. 21, 2000

(87) PCT Pub. No.: WO00/01491

PCT Pub. Date: Jan. 13, 2000

(30) Foreign Application Priority Data

Jul. 3, 1998 (JP) ..... 10-188779

(51) Int. Cl.[7] ..... B05B 1/00

(52) U.S. Cl. ..... 239/596; 239/102.1; 239/102.2; 239/99; 239/95; 239/533.1; 239/584; 239/589

(58) Field of Search ..... 239/102.1, 102.2, 239/99, 95, 533.1, 533.2, 584, 596

(56) References Cited

U.S. PATENT DOCUMENTS

| | | | | |
|---|---|---|---|---|
| 4,695,854 A | | 9/1987 | Cruz-Uribe | |
| 5,305,018 A | * | 4/1994 | Schantz et al. | 219/121.71 |
| 5,381,162 A | * | 1/1995 | Roy et al. | 347/10 |
| 5,646,662 A | * | 7/1997 | Kitahara | 347/47 |
| 5,969,733 A | * | 10/1999 | Sheinman | 347/75 |
| 6,126,339 A | * | 10/2000 | Kobayashi | 239/102.2 |
| 6,260,272 B1 | * | 7/2001 | Inose et al. | 29/890.1 |

FOREIGN PATENT DOCUMENTS

| | | |
|---|---|---|
| EP | 0 572 231 B1 | 12/1993 |
| JP | 6-40030 | 2/1994 |
| JP | 6-99105 | 4/1994 |
| JP | 8-274014 | 10/1996 |
| JP | 11-314030 | 11/1999 |

* cited by examiner

*Primary Examiner*—Robin O. Evans
(74) *Attorney, Agent, or Firm*—Burr & Brown

(57) ABSTRACT

A device for discharging raw material-fuel includes a pressurizing means for discharging a liquid, a pressure application room (1) in fluid communication with a discharge nozzle, and a liquid discharge nozzle (2) positioned under the pressure application room to discharge the liquid. The nozzle portion has an aspect ratio (L/d) of 5 or more, with L being the length of the nozzle in the thickness direction of the nozzle portion and d being the diameter of the nozzle portion.

4 Claims, 2 Drawing Sheets

DEVICE FOR DISCHARGING RAW MATERIAL-FUEL

TECHNICAL FIELD

The present invention relates to a device for discharging raw material•fuel to be used for various machines operating by discharging liquid raw material or fuel or various machines treating the above liquid by discharging liquid raw material or fuel.

BACKGROUND ART

With improvement of the remarkable degree of integration beyond expectation in the field of semiconductor, it is the present conditions that needs of provision of the various materials required for production of semiconductor having high degree of integration or needs in a market for the devices capable of discharging liquid as minute particles in various kinds of material processing such as various chemical reactions, drying, mixing, coating, and combustion, and the like which are the processing means required to cope with the spread of the application fields of semiconductors is rising still more. For example, an ink-jet device employed in a press essential for the office electronic machinery that is a liquid discharge device used most frequently is disclosed in JP-A-6-40030.

However, as discussed above a demand with respect to a device to discharge fuel as minute particles shows the spread that exceeds expectation, and there is not in the state that an ink-jet device can be employed for such a use as it is since there are peculiar requirements, depending upon its way of use. In particular, in fields such as industrial machinery and durable consumer goods, the use conditions are different; and in some use conditions, an air bubble formed by mechanical vibrations generated in response to use environment enters into a pressure application room, and even if pressure application to a pressure application room is tried, the entered air bubble transforms and shrinks to absorb a part of or all the applied pressure, and a situation that discharge of the aimed liquid is not performed as intended often occurs. Thus, a problem that a desired effect is not exhibited is caused.

The present invention provides a liquid discharge device (raw material/fuel discharge device) having the structure that can prevent an air bubble from entering into a liquid discharge device so as not to cause such liquid discharge defectiveness or inability due to an air bubble entered from a nozzle.

DISCLOSURE OF INVENTION

The present inventors studied in various ways in view of such present conditions as the above, and as a result found that an air bubble generated by mechanical vibrations can be effectively prevented from entering into a pressure application room by using a nozzle having an aspect ratio (L/d) of 5 or more to prevent an air bubble generated by mechanical vibrations or the like from entering into a pressure application room (1), and the present invention was completed.

According to the present invention, there is provided a device for discharging raw material•fuel comprising: a pressurizing means to discharge liquid, a pressure application room (1) to discharge liquid, and a liquid discharge nozzle (2) provided under the pressure application room; wherein said nozzle has an aspect ratio (L/d) of 5 or more.

BEST MODE FOR CARRYING OUT THE INVENTION

Figure 1:
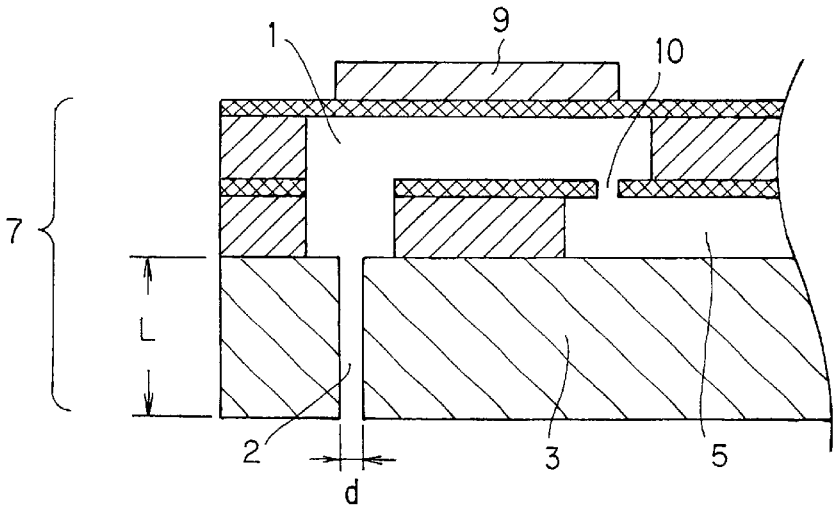
FIG. 1 is sectional side elevation of an embodiment of a device for discharging raw material•fuel of the present invention.

The present invention is hereinbelow described in detail.

A device for discharging raw material•fuel (hereinbelow sometimes referred to as liquid discharge device) of the present invention comprising: a pressurizing means to discharge liquid, a pressure application room (1) to discharge liquid by applying pressure, and a liquid discharge nozzle (2) provided under the pressure application room; characterized in that said nozzle has an aspect ratio (L/d) of 5 or more. In the present invention, an aspect ratio (L/d) means the ratio of length L of a nozzle to diameter d of a nozzle.

A shape of a nozzle of the present invention is not particularly limited as long as the nozzle has an aspect ratio (L/d) of 5 or more. Nozzles having such an aspect ratio are, for example, ones having a cylindrical shape, ones having a tube-like form body of a square roof, ones having either one of the above two shapes, and ones further having a small cavity and ones further formed of a multistage taper.

A device for discharging raw material•fuel structure may have a constitution by from several to hundreds units of the above devices for discharging raw material•fuel, each of which is considered as one unit.

The structure for discharging liquids (7) is constituted by a pressure application room (1), a flow path (5) for supplying liquid to be discharged which communicates with the pressure application room (1) via a minute hole (10) for preventing countercurrent, the communicating hole which connects a nozzle with the pressure application room (1), a nozzle portion (3) having a nozzle (2) which is a bore to discharge liquid materials as fine particles via the communicating hole which is located under the pressure application room (1). The structure comprises a first layer having the pressure application room (1), a second layer having a liquid supply flow path (5) to supply liquid a pressure application room (1), the second layer being provided under the first layer, and a third layer having a nozzle portion (3) provided under the second layer. The pressure application room (1) and the nozzle (2) communicates with each other via the communicating hole.

As a pressurizing means to discharge liquid, a piezoelectric/electrostrictive membranous element is adopted usually.

The piezoelectric/electrostrictive membranous element (9) is a well-known member for a person of ordinary skill in the art. A method to provide the piezoelectric/electrostrictive membranous element to a structure for discharging liquid (7) may be in accordance with a well-known method.

In a device for discharging raw material•fuel of the present invention, a structure for discharging raw material•fuel formed from three layers usually is produced by unitarily molding a ceramic material to give a compact having a predetermined shape in accordance with a method as defined in Japanese Patent Application No. 9-335210 and firing the compact.

The pressure application room (1) communicates with the nozzle (2) via the communicating hole.

In addition, the pressure application room (1) communicates with the liquid supply flow path (5) via the minute hole (10) for preventing countercurrent.

The pressure application room (1) generally has a shape such as cylindrical, elliptic cylindrical, rectangular, or the like. The volume is determined according to a mode of use.

Over the pressure application room (1), is disposed the piezoelectric/electrostrictive membranous element (9) which is a pressurizing means. Lead wire and electrode (not shown) which are required to send an electric signal for applying pressure are connected to the piezoelectric/electrostrictive membranous element (9).

The nozzle (2) is formed so as to be held inside the nozzle portion (3) which is the third layer.

It is necessary that a nozzle (2) has the ratio of a length L of a nozzle to a diameter d of a nozzle, which is expressed as aspect ratio (L/d), is at least 5, preferably 10 or more, in order to prevent an air bubble from entering. However, if the ratio is above 15, it is unfavorable because a diameter of a nozzle is too small, which sometimes cause an obstacle in production.

The nozzle may be cylindrical or have a tube-like form body having a square cross-section. The nozzle may have a small cavity (4) for trapping an air bubble provided around a tip portion of the cylindrical nozzle or may have a multistage taper structure (8). It is preferable that the nozzle has a small cavity (4) for trapping an air bubble and it is further preferable that the nozzle has a multistage taper structure (8) from the point of preventing an air bubble from entering.

As locational relation of an air bubble trap providing around the tip of the discharge port of the nozzle, it is preferable that a ratio $L_1/L_2$ of a distance $L_1$ from the tip of the pressure application room side to the tip of the trap side to a distance $L_2$ from the tip of the pressure application room side to the tip of the discharge port side is equal to or more than 5 in a plane perpendicular to a longitudinal direction of a pressure application room (1) of the above small cavity (4).

When the nozzle has a multistage taper structure, it is preferable that the nozzle has a diameter which becomes bigger in turn from a nozzle located in the side of the communicating hole to the nozzle which is located in the side of the tip of the discharge port because an air bubble can be trapped more. The number of steps to be used is at least two, and preferably four. Height of each step is approximately same from a viewpoint on production. Of course height of each step can be appropriately changed depending on a use.

A liquid discharge device of the present invention is hereinbelow described further concretely with reference to FIGS. 1–3 each showing a sectional side elevation of some embodiments of a device for discharging raw material/fuel of the present invention.

The liquid discharge structure employed in a liquid discharge device shown in FIG. 1 can be produced by molding a compact having a pressure application room provided in a first layer (1), a liquid supply flow path (5) which is provided in a second layer located under the first layer and which communicates with the pressure application room (1) via a minute hole (10) for preventing countercurrent, the communicating hole which connects a nozzle with the liquid supply flow path (5), and the nozzle (2) provided in a third layer which is located under the second layer with employing a ceramic material, for example, a partially stabilized zirconia powder and an appropriate aid such as binder and solvent according to, for example, a method disclosed in Paragraph Numbers 0010–0013 of Japanese Patent Application No. 9-335210. In addition, it becomes necessary to determine the length L and diameter d of the nozzle (2) for the purpose of setting an aspect ratio to be at least 5. As a method of forming a nozzle, a general technique such as punching or cutting may be employed.

Figure 2:
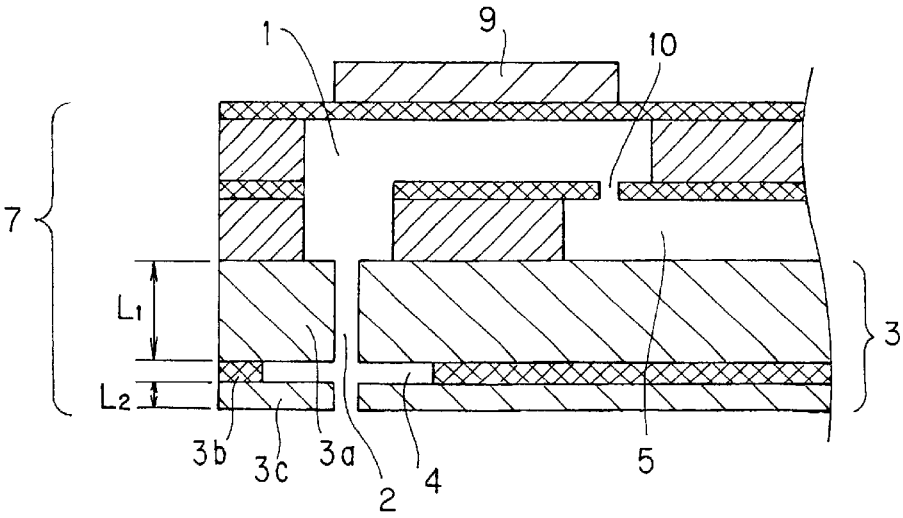
FIG. 2 shows a sectional side elevation of another embodiment of a device for discharging raw material•fuel of the present invention.

The liquid discharge structure (7) employed in a device for discharging raw material•fuel shown in FIG. 2 can be produced by molding a compact having a pressure application room provided in the first layer (1), a liquid supply flow path (5) which is provided in the second layer located under the first layer and which communicates with the pressure application room (1) via a minute hole (10) for preventing countercurrent, the communicating hole which connects the liquid supply flow path (5) and a nozzle, and the nozzle (2) provided in the third layer which is located under the second layer and having a small cavity (4) around a discharge port with employing a ceramic material, for example, a partially stabilized zirconia powder and an appropriate aid such as binder and solvent according to, for example, a method disclosed in Paragraph Numbers 0010–0013 of Japanese Patent Application No. 9-335210.

Incidentally, in this case, the nozzle (2) to which a small cavity (4) was provided around a discharge hole must determine a position of a small cavity (4) by adjusting thickness of three layers, i.e., a 3*a* layer, a 3*b* layer, and a 3*c* layer for the purpose of setting the ratio $L_1/L_2$ of distance $L_1$ between the tip of the pressure application room side and the tip of the trap side to distance $L_2$ between the tip of the trap side and the tip of the discharge hole side in a plane perpendicular to a longitudinal direction of the pressure application room (1) of the above small cavity (4) to be at least 5. The size of a small cavity is in the range of $5\times(\pi\phi^2/4)$ to $20\times(\pi\phi^2/4)$ when a nozzle diameter is $\phi$. In the small cavity (4), a 3*b* layer may be formed by the technique of machine work such as punching or a laser processing before laminating in FIG. 2. Of course, in this case, it is necessary to fix the length L and diameter d so that the nozzle (2) has an aspect ratio of at least 5.

Figure 3:
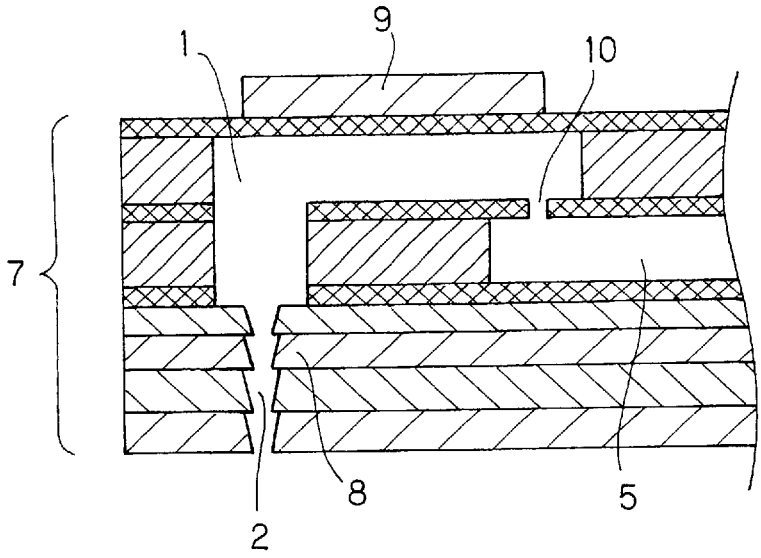
FIG. 3 shows a sectional side elevation of still another embodiment of a device for discharging raw material•fuel of the present invention.

The liquid discharge structure employed in a device for discharging raw material•fuel shown in FIG. 3 can be produced by molding a compact having a pressure application room provided in the first layer (1), a liquid supply flow path (5) which is provided in the second layer located under the first layer and which communicates with the pressure application room (1) via a minute hole (10) for preventing countercurrent, the communicating hole which connects the liquid supply flow path (5) and a nozzle, and the nozzle (2) provided in the third layer which is located under the second layer and formed of a taper multistage with employing a ceramic material, for example, a partially stabilized zirconia powder and an appropriate aid such as binder and solvent according to, for example, a method disclosed in Paragraph Numbers 0010–0013 of Japanese Patent Application No. 9-335210. In this case, it is necessary to fix the length L and diameter d so that the nozzle (2) has an aspect ratio of at least 5.

In this case, the nozzle (2) which is formed by a taper of multistage may employ the third layer constituted of the number of steps to be desired. A nozzle diameter of each step is made to be the same, or a diameter of a nozzle formed in the upper step is smaller than one formed in the lower step. It is preferable that a section of each nozzle is formed to be smaller in a portion near to a discharge hole than at the side of the pressure application room (1) because a trap effect of an air bubble rises. Of course, in this case, it is necessary to fix the length L and diameter d so that the nozzle (2) has an aspect ratio of at least 5.

Industrial Applicability

According to a raw material/fuel discharge device of the present invention, the trapped air bubble can be released securely.

A device of the present invention is useful as a discharge device upon combustion of fuel required for a stable liquid discharge or various liquid raw material or upon drying processing. That is, a device of the present invention can be suitably employed as a liquid discharge device upon supplying liquid for raw material for reaction or drying of solution containing an aimed product or a discharge device for various liquid fuel such as oil including an oil fan heater or the like.

What is claimed is:

1. A device for discharging raw material or fuel, comprising:

pressurizing means for discharging a liquid; and a discharge cavity in fluid communication with a liquid discharge nozzle and being positioned on said nozzle, said nozzle having a nozzle bore width defined by spaced apart, parallel lines extending from said discharge cavity to a discharge opening of said nozzle, and a distance between said parallel lines being substantially the same from said discharge cavity to said discharge opening, wherein said nozzle has an aspect ratio, L/d, of at least 5:1, L being the length of the nozzle in the thickness direction of a nozzle portion of the device, and d being said width of said nozzle bore.

2. A device for discharging raw material or fuel according to claim 1, said nozzle further comprising a trap cavity having first and second ends for preventing backflow of the liquid, wherein a ratio $L_1/L_2$ is at least 5:1, $L_1$ being a distance between a portion of said nozzle bore proximate said discharge cavity and a portion of said nozzle bore proximate said first end of said trap cavity, and $L_2$ being a distance between a portion of said nozzle bore proximate said second end of said trap cavity and a portion of said nozzle bore proximate said discharge opening of said nozzle bore.

3. A device for discharging raw material or fuel according to claim 2, wherein said trap cavity has a bore width defined by spaced apart, parallel lines extending from said first end of said trap cavity to said second end of said trap cavity, and said trap cavity bore width differs from the width of said nozzle bore.

4. A device for discharging raw material or fuel, comprising:

pressurizing means for discharging a liquid; and a discharge cavity in fluid communication with a liquid discharge nozzle and being positioned on said nozzle, said nozzle having a multistage taper extending downwardly from said discharge cavity to a discharge opening of said nozzle, each stage of said multistage taper having a first end located proximate said discharge cavity and an opposed second end, and said first end of each stage is larger than said second end of all stages, wherein said nozzle has an aspect ratio, L/d, of at least 5:1, L being the length of said nozzle in the thickness direction of a nozzle portion of the device, and d being a width of said nozzle portion defined by spaced apart lines extending from said discharge cavity to said discharge opening of said nozzle.

* * * * *